United States Patent [19]

Ellis

[11] Patent Number: 4,881,291

[45] Date of Patent: Nov. 21, 1989

[54] LOTTERY TICKET SCRAPER ENABLING PRECISE REMOVAL OF SURFACE LAYER FROM TICKET

[76] Inventor: John L. Ellis, 301 Birch Ter., Winter Springs, Fla. 32708

[21] Appl. No.: 194,103

[22] Filed: May 16, 1988

[51] Int. Cl.[4] ..... A47L 13/02; B26B 3/00

[52] U.S. Cl. ..... 15/236.01; 30/169; 30/136.5

[58] Field of Search ..... 15/236.01–236.10; 30/136.5, 169–172, 280

[56] References Cited

U.S. PATENT DOCUMENTS

| | | | |
|---|---|---|---|
| 458,463 | 8/1981 | Kaiser | 30/136.5 X |
| 903,053 | 11/1908 | Brown . | |
| 1,385,294 | 7/1921 | Zorn | 30/136.5 |
| 1,643,856 | 9/1927 | Romero | 15/236.01 |
| 2,081,706 | 5/1937 | Kilcup . | |
| 2,558,335 | 6/1951 | Bert . | |
| 2,649,604 | 8/1953 | Hess . | |
| 4,115,892 | 9/1978 | Stickler . | |
| 4,248,660 | 2/1981 | Johnson . | |
| 4,601,776 | 7/1986 | Kral | 30/172 X |
| 4,637,090 | 1/1987 | Kennedy | 15/236.08 |
| 4,646,382 | 3/1987 | Smith . | |
| 4,654,923 | 4/1987 | Faciane et al. . | |

*Primary Examiner*—Peter Feldman

*Attorney, Agent, or Firm*—Julian C. Renfro

[57] ABSTRACT

A hand held device is herein provided for selectively scraping a surface layer from the face of a lottery ticket or the like, with this device having a housing member upon which a blade is mounted, with the housing having a central cavity for catching and retaining the scraped material removed from the lottery ticket. My novel device comprises upper and lower, generally triangularly shaped members mounted in a spaced apart relationship, and bounded by sidewalls. These sidewalls serve with the upper and lower members to define the central cavity. The blade for scraping the surface of the lottery ticket is supported at a front corner of my device, and an opening is disposed directly above the blade, and generally parallel therewith. This opening makes it readily possible for material scraped from the lottery ticket to enter my device and be retained in the central cavity. When the housing member is full, a slider member can be momentarily moved aside to permit the user to drop the scraped material directly into a trash receptacle.

10 Claims, 2 Drawing Sheets

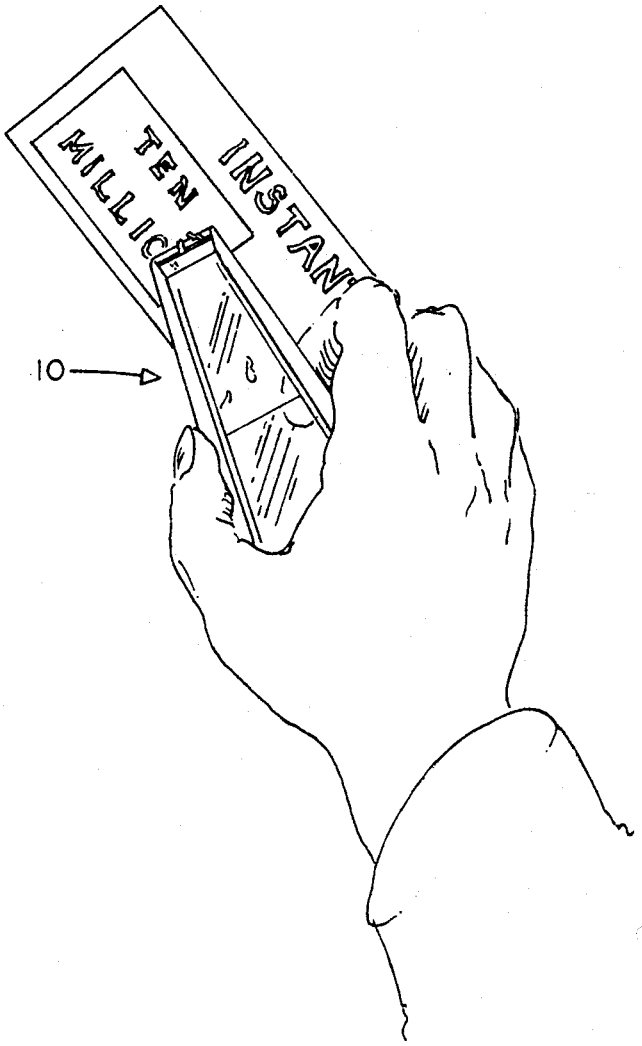
FIG 1
FIG 2
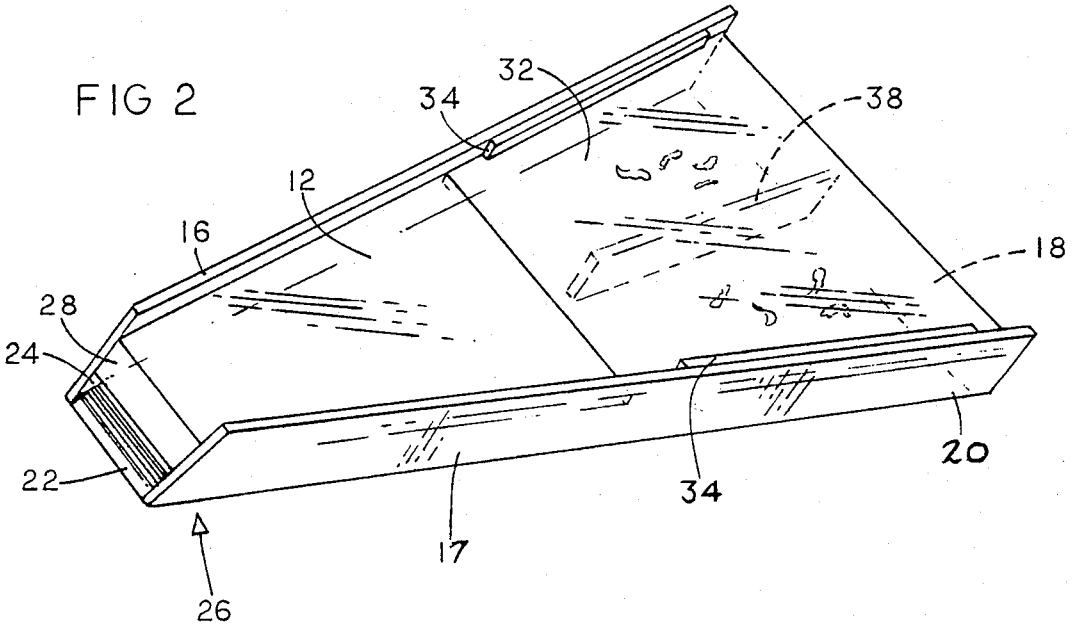

LOTTERY TICKET SCRAPER ENABLING PRECISE REMOVAL OF SURFACE LAYER FROM TICKET

FIELD OF THE INVENTION

This invention relates to scraping devices generally, and more specifically, this invention relates to a hand held device enabling the surface layer to be carefully and precisely removed from a lottery ticket or the like, with the scrapings then retained in the body of the device.

BACKGROUND OF THE INVENTION

Lottery ticket buyers that buy a single lottery ticket, or a string or strip of such tickets, are faced with the problem of carefully removing the film or occluding layer from the face of each ticket, as by the slow manipulation of the rounded edges of a coin, or by the use of a pocket knife, or the like, so as to scrape off the film or surface layer from the ticket or tickets. This may damage one or more of the alphanumeric characters or numbers on a ticket substrate, and becomes a laborious task when a large number of strung together tickets are to be processed. There is need for a hand held device to greatly reduce such labor, and to enable quick and effective removal of the film from a single ticket, or from a string of interconnected tickets. There is also the need to catch and retain the material scraped off, so that it will not clutter and defile the surrounding area.

It is of course known that many lottery tickets include a backing of cardboard or other rigid stock material, with printed indicia thereon, and an opaque coating over some or all of the indicia. The purchaser paying money into the state is of course hoping that by scraping the ticket he or she will regain more money than he or she paid in. The state, however, is careful to minimize the fact that the odds against a given person winning any substantial amount of money in a lottery are several million to one.

Notwithstanding the fact of the enormous odds against winning, the population flocks to the grocery store, the service station, the all-night liquor store, the drug store, and every other conceivable kind of merchandising operation wherein lottery sales have become a major source of activity. As the frantic lottery ticket purchaser grasps his ticket to instant wealth, he is confronted with a real dilemma—how best to scrape the lottery ticket!

First of all, one must have an object with a slightly sharp edge. As mentioned earlier, coins are sometimes used, but these have a rounded edge and are often unsatisfactory. Pocket knives are sometimes used, but these tend to cut through the ticket, and may cut a finger as well. Nail files, credit card edges, razor blades and virtually every other conceivable kind of device with a sharp edge is used in the frantic race to scrape the opaque surface layer or covering from the face of the lottery ticket, so as hopefully to entitle the purchaser to instant riches.

Most or all of these removal methods are only moderately satisfactory. One great hazard involved in most of these methods lies in the fact that in the type of lottery ticket used by some states, if the number of the ticket, which is covered by the opaque covering, is disclosed by removing the opaque covering in that area, the lottery ticket becomes void. Thus, sadly, the dream of instant wealth might be cut asunder by a careless scrape!

Quite significant is the fact that the surface layer of many types of lottery tickets is slightly sticky, and prone to create an unsightly mess on a counter or table, and/or on the floor.

The present invention solves these problems and frees the ticket purchaser from the risk of destroying the validity of the lottery ticket, and provides a simple, low cost, efficient and effective means for scraping lottery tickets, and for disposing of the scraped material quite cleanly and conveniently.

SUMMARY OF THE INVENTION

The present invention comprises a hand held lottery ticket scraper constructed of generally triangularly shaped upper and lower members, with sidewalls being disposed around two sides and the rear of the device, and with a nose portion being created in what may be regarded as the front corner of the device, so as to enable the user to effectively and selectively scrape away the opaque coating from selected portions of a lottery ticket.

The sidewalls serve in concert with the upper and lower generally triangularly shaped members to define a housing portion or central cavity in which scraped material can be caught and retained. Means are provided at a lower part of the nose portion of my device to support a blade, and an opening or slot parallel with the blade is disposed directly above the blade, to enable material scraped from a lottery ticket to enter the opening and be retained in such housing portion of my device.

The material scraped from the upper surface of the lottery ticket may be of latex or the like, and in the case of many lottery tickets, this scraped material is quite sticky. As a result, if the purchaser of the lottery ticket is not extremely careful, he or she will cause a sticky mess to be created on a counter or table, and/or on the floor. To this end, the structural components of my device cooperate together to define a housing member in which the scraped material is caught and effectively contained until such time as dumping of the scraped material becomes necessary or desirable.

One of the members constituting the housing is preferably configured to be slidable with respect to the other components, so that the user, when he or she decides to dump the contents of the device, need only stand above a trash receptacle or garbage can, and then move the slider member temporarily to the open position. In this way the scrapings can be disposed of without the user of my device needing in any way to soil his or her hands.

One of the important features of my invention is the configuring of my hand held device to have a rather pointed nose portion, so that the user can employ my device in a very precise and careful manner. Because of the very advantageous, high visibility construction made possible by the configuration I use, only selected portions need be scraped away and removed from the lottery ticket. Not only is the nose portion deliberately made narrow, but also it is, in a manner of speaking, swept back so that the user can closely observe exactly which portion or portions of the lottery ticket or other such item or component are being scraped away at any given moment.

It is therefore a primary object of my invention to provide a highly effective scraper for a lottery ticket or the like, which is of low cost, readily used in a precision manner, and non-destructive insofar as the lottery ticket is concerned.

It is another object of my invention to define a hand held scraper featuring a comparatively narrow blade supporting portion, which is configured to provide high visibility with regard to the location of the blade, thus enabling the user to selectively scrape away only certain parts of the upper surface of a lottery ticket or the like.

It is still another object of my invention to provide a hand held scraper of low cost and effective construction, with the arrangement being such that the scrapings from the ticket are directly ingested into the elongate body or housing of the scraper device, and retained against spillage until such time as the user decides to effect a dumping of the scrapings into the appropriate receptacle.

It is yet another object of my invention to define a generally triangularly shaped, hand held device of low cost, having a comparatively narrow nose portion in which a narrow blade is supported, with a swept back nose configuration affording the user a high degree of visibility as to the portions of the lottery ticket being removed by the blade.

It is yet still another object of my invention to define a generally triangularly shaped, hand held device of low cost, having a nose portion in which a narrow blade is supported, with an opening or slot disposed just above such blade readily permitting the scrapings from a lottery ticket or the like to enter the body or central cavity of the device, from which the scrapings can at an appropriate time be readily and cleanly dumped.

These and other objects, features and advantages of my improved lottery scraper will become more apparent as the description proceeds.

BRIEF DESCRIPTION OF DRAWINGS

FIG. 1 is a perspective view of a hand held scraper device in accordance with my invention, this generally elongate device being usable in a selective manner for scraping away the surface covering portion of a lottery ticket or the like;

FIG. 2 is a perspective view of my scraper device in which the somewhat triangularly shaped housing with its diverging side portions is clearly revealed, in the front of which housing is a scraper blade immediately above which is an opening for receiving the scraped material;

DETAILED DESCRIPTION

Turning to FIG. 1, it will there be seen that I have depicted a preferred embodiment of my elongate hand held scraper device 10 particularly designed for enabling a user to selectively scrape away the surface layer from a lottery ticket or the like, so as to expose the number information, this being accomplished in such a way as to avoid damaging the information provided at other locations on the face or front of the ticket.

The device 10 preferably comprises a pair of generally triangularly shaped members 12 and 14, with member 12 being the upper member, and 14 being the lower member, with both of these members typically being essentially flat and made of transparent plastic. The lower member 14 is better shown in FIG. 3.

Figure 3:
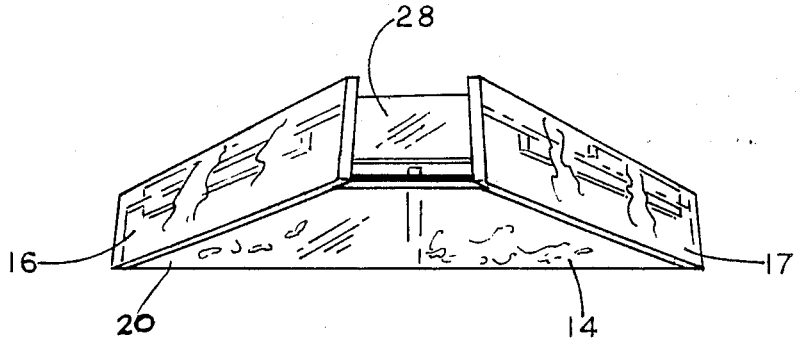
FIG. 3 is a front view taken somewhat below the blade to make the slot or opening directly above the blade clearly visible.
Figure 4:
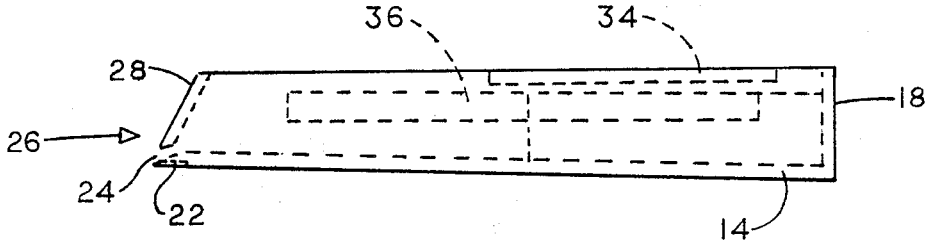
FIG. 4 is a cross-sectional view showing certain interior constructional features of the hand held scraping device in accordance with my invention.

The preferred configuration of my hand held device may be seen from FIGS. 1, 2 and 3 to involve diverging side portions or sidewalls 16 and 17. Indicated in FIG. 2 but better shown in FIG. 4 is a rear sidewall 18 of comparatively short height, with the top and bottom members in connection with the sidewalls defining an enclosed container in which is provided a central cavity, this to be utilized for a purpose shortly to become apparent. I deliberately configure the front corner of my device to form a nose portion 26 of comparatively narrow construction, involving the use of a rearwardly slanted front sidewall member 28.

The sidewalls 16 and 17 and the rear wall 18, along with the fixed upper member 12, the lower member 14, and the swept back front sidewall member 28 of the nose portion 26 are secured together by the use of an appropriate glue or cement to form what may be regarded as a housing or housing member 20.

One of the important aspects of this invention is the utilization of a metal blade or blade member 22 in the lowest part of the nose portion 26. Disposed immediately above the blade 22 is an opening or slot 24 into which the scrapings created by the use of the blade 22 pass and become entrapped in the central cavity 30 of the housing member 20. It is to be realized that the blade 22 is essentially parallel to the plane of the lower member 14, and has a flat undersurface, being preferably secured on the underside of bottom member 14.

There are, however, a number of different ways the blade 22 can be placed in a functional position, and for example, the blade can be secured in a slight recess in the front edge of the lower member, although it is usually not necessary to go to the expense of creating the recess. The blade 22 may be fixed either in the plane of member 14, or else fixed at a slight downwardly inclined angle as a result of providing a downwardly sloped recess in the bottom member. An option other than the use of glue or cement is to heat the blade sufficiently to cause a slight amount of melting of the plastic, with this causing the blade to be secured to the bottom member 14. Another option is to use mechanical retention means at the front of my device, into which the blade is snapped. Still another option is to use one or more tiny rivets or screws for holding the blade 22 to the front of the bottom member 14.

Figure 4A:
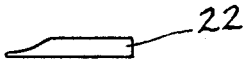
FIG. 4*a* is a showing to an enlarged scale of a typical scraper blade, as viewed from its edge.

As best seen in the somewhat enlarged showing of a typical blade 22 appearing in FIG. 4*a*, each blade preferably has an upper edge that curves upwardly a bit from the forward edge of the blade, thus forming a type of "lift" for the removed scrapings. In other words, I may use a blade having an upper surface possessing slope or curvature that aids the scraped material to enter the slot 24 disposed immediately above the blade 22.

Although the upper and lower members 12 and 14 are, as previously mentioned, of generally triangular shape, it is to be realized that these members at the location of the front or nose portion 26 of my device do not come to a point. Rather, these members define the nose portion to have a comparatively narrow width, and to have a decided amount of sweepback, as perhaps best seen in FIGS. 2 and 4, accomplished by gluing the front sidewall member 28 at a backwardly swept angle. This idealized construction readily enables the user of my device to selectively scrape away only intended portions of the lottery ticket, thus leaving the other portions undisturbed and undamaged.

Although the diverging sidewalls 16 and 17 extending along each of the long sides of my device are generally disposed at a right angle to the upper and lower triangularly shaped members 12 and 14, because as earlier indicated, the front sidewall member 28 of the nose portion 26 is preferably angled somewhat rearwardly, this has the effect of making the upper triangularly shaped member 12 somewhat smaller than the lower triangularly shaped member 14. This preferred configuration utilizing the rearwardly swept nose 26 portion provides excellent visibility for the user of my device, so that he or she can closely observe the blade action and be enabled to selectively and carefully scrape away only desired portions of the lottery ticket or other such item.

As should now be apparent, as the user pushes the forwardmost portion of the blade 22 along the surface layer to remove such surface layer from the portion of the lottery ticket containing the numbers or other such information, the removed portion typically stays in one piece or strip, and because of the nearness of the slot or opening 24, the piece or strip of what was once the surface layer is caused to immediately enter the opening 24, and be caught and retained in the interior or central cavity 30 of the housing member 20. From many tests I have found that the slot or opening 24 is effective to catch long pieces as well as short pieces of the removed material. As a result of this highly efficient action, the unsightly mess usually to be found on the counter, table or floor in the vicinity of a scraped lottery ticket can now be carefully avoided.

Although the blade 22 can be made of plastic, I have found a metal blade in the form of a small pencil sharpener blade or the like to be most desirable. The blade is preferably flat on the bottom, with the upper edge of the blade curving upward from the front edge, as previously mentioned. I have found that the best results are achieved when the cutting edge of the blade has been slightly dulled.

Figure 5:
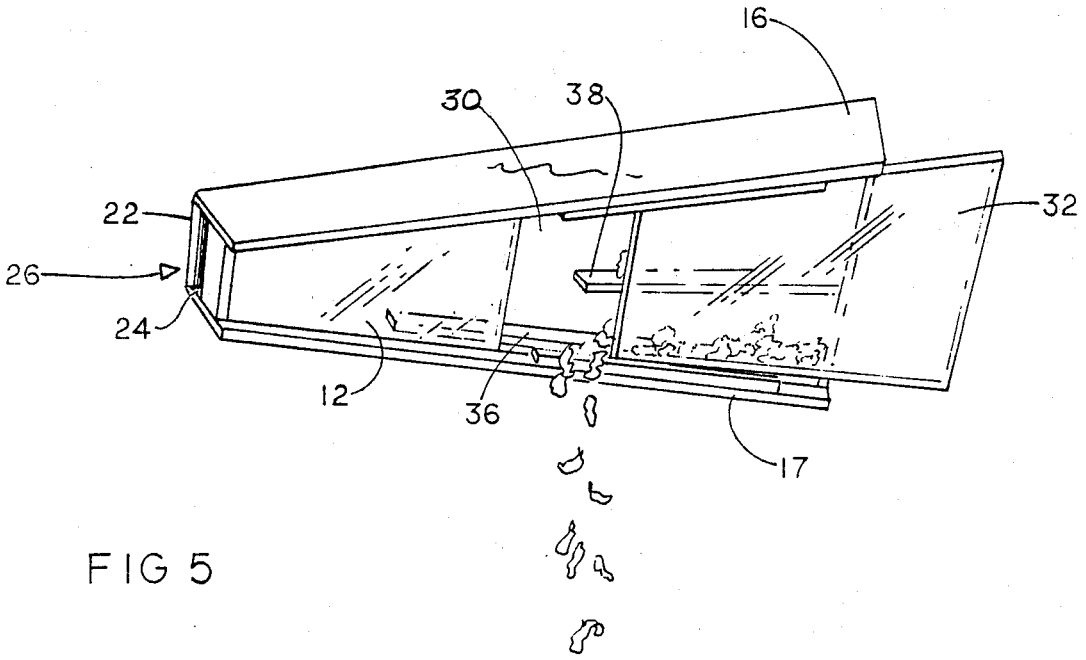
FIG. 5 is a view showing the manner in which the user may go about dumping the scrapings out of the interior or cavity portion of my hand held device.

To facilitate dumping of the material scraped away from the ticket, I preferably create the upper member 12 to have a fixed front portion, and a movable rear portion or slider 32, these being best seen in FIGS. 2 and 5. The movable rear portion 32 is in the configuration of a truncated triangle, which is retained in the desired relationship to the upper portions of the left and right sidewalls of my device by the use of upper and lower slide-defining members 34 and 36. Typical upper members 34 are to be seen in FIG. 2, with one of each of the members 34 and 36 being indicated in dashed lines in FIG. 4. It is to be understood that such members are used on the upper interior portions of each of the sidewalls 16 and 17. The members 34 and 36 used on each sidewall are spaced apart only enough to slightly grip the respective edges of the slider member 32. This is so in order that the movable rear portion or slider member 32 will not be jarred out of the desired relationship with the other members of my device. The consequence of the slider member 32 becoming moved or misaligned from the closed position is that the spilling of the scrapings from the housing of my device might be permitted to occur at an inopportune or inappropriate time.

I could configure the rear sidewall 18 to be of snap-in construction, rather than utilizing the slider member 32, so that the scrapings could be dumped from time to time from the rear of the device. This, however, is not the preferred construction, for I have found the use of the slider member 32 to be ideal.

As should now be clear, the pair of upper and lower support members 34 and 36 are disposed in parallel, closely spaced relation along the upper interior of each of the sidewalls 16 and 17, to form an effective support for the slider member, with the pairs of support members being configured such that the left and right edges of the movable rear portion or slider 32 will be engaged tightly enough as to prevent the slider 32 from undesirably moving away from the closed position, and thus making sure that the scraped away material will not spill out of the central cavity of the housing at an unexpected and undesirable time. One of the lower slide support members 36 is visible in FIG. 5.

Because of the movable rear portion or slider 32 being in the shape of a truncated triangle, and because of the divergence of the sidewalls 16 and 17, the slider 32 would fall away from its engagement with the pairs of upper and lower members 34 and 36 upon being moved rearwardly, away from the position in which its front edge engages the rear edge of the fixed forward portion of the upper member 12. If no means were provided to prevent the movable rear portion or slider 32 from dropping into the housing portion, this might easily occur, so to this end I provide a member for keeping the movable rear portion or slider 32 from falling into the housing. The member I provide is a spine member or central support 38, best seen in FIGS. 2 and 5, the height of which is the same as the height of the rear sidewall 18 of my device. In that way, the upper surface of the spine member 38 serves to support the movable rear portion 32 in a desired relationship to the members 34 and 36 throughout its movements, both toward and away from the closed relationship with respect to the fixed forward portion of the upper generally triangular member 12.

As should now be apparent, because of the effective design of my device, the user can employ my device to carefully scrape away the upper surface of a lottery ticket, so that the number or word information contained upon the lottery ticket can be readily revealed to the purchaser. Because the nose portion 26 of my device is comparatively narrow, and the front sidewall member 28 is of swept back configuration, the user of my device is enabled to see how to carefully scrape away only selected portions of the lottery ticket.

When the user has determined that the contents of the housing member 20 should be dumped, he or she should stand very close to a trash or garbage receptacle, move the slider member 32 rearwardly, and then turn the device onto one side in the general manner shown in FIG. 5, while holding onto the slider member. In this way the scrapings can be dropped directly into the trash or garbage receptacle, thus avoiding the creation of a messy tabletop, countertop or floor. Thereafter the slider member is returned to the closed position so that the scraping function can be resumed, and the scrapings captured.

I am not to be limited to any particular constructional details, but in one embodiment that was particularly effective, the lower, generally triangular member 14 was $3\frac{3}{4}$ inches long, having a width of $\frac{1}{2}$ inch to 9/16 inch at the front or forwardmost location, and a width of $1\frac{1}{2}$ inches at the rear.

It is preferable for the nose member 28 to have a 45° sweepback, so as a result, the top member has a total length of 3 9/16 inches, a width of 9/16 inch at the front, and a width of $1\frac{1}{2}$ inches at the rear. In the event a slider member 32 is created out of the top member, I prefer for the slider member to be $2\frac{1}{8}$ inches long, with the fixed front portion then being 1 7/16 inches long.

The front sidewall member or nose piece 28 is $\frac{1}{2}$ inch wide, and typically longer than 7/16 inch, because of its rearward slope. The blade 22 is typically 5/16 inches wide, from front to back, and $\frac{1}{2}$ inch to 9/16 inches long, from left to right, with the slot 24 having approximately the same left-right dimension as the blade.

Although not required, instead of the left and right members 16 and 17 being of uniform height, they may be approximately 7/16 inches high at the location of the nose portion, and slightly higher at the location of the rear member, for example being $\frac{5}{8}$ inches high at the rearmost location. The rear member or rear sidewall 18 is of the full $1\frac{1}{2}$ inches width, but is typically only $\frac{1}{4}$ inch high inasmuch as the underside of slider member 32 is in direct contact with the upper edge of the rear member 18. As previously mentioned, the central spine member 38 has the same height as the rear member 18, but may slope somewhat downwardly toward the front in the event of the sidewalls 16 and 17 sloping downward toward the nose piece.

I prefer for the members of my device, except the blade 22, to be of plastic and held firmly in the described relationships by the use of a suitable glue or cement. The use of transparent plastic is preferred, so that the user can become aware of the central cavity becoming full of scrapings, and thereby in need of emptying.

I am not to be limited to the details of my invention set forth above, except as required by the scope of the appended claims.

I claim:

1. A hand held device for scraping only a surface layer from the face of a lottery ticket or the like and having means to catch and retain the scraped material, said device comprising upper and lower generally triangularly shaped members mounted in a spaced apart relationship, and bounded by sidewalls serving with said members to define a housing portion in which scraped material can be caught and retained, a nose portion of comparatively narrow construction, involving a rearwardly slanted front portion, means supporting a flat blade at the bottom of said rearwardly slanted front portion, in a position clearly visible to the user, an opening disposed directly above said blade, and generally parallel therewith, to enable material scraped from the lottery ticket to enter said opening and be retained in said housing portion, the visibility afforded the user by the rearwardly slanted front portion enabling the user to readily scrape away only selected portions of the lottery ticket or the like.

2. A hand held device for scraping only a surface layer from the face of a lottery ticket or the like, and having means to catch and retain the scraped material, said device comprising upper and lower generally triangularly shaped members mounted in a spaced apart relationship, and bounded by sidewalls serving with said members to define a housing portion in which scraped material can be caught and retained, means supporting a blade at a front corner of said device, an opening disposed directly above said blade, and generally parallel therewith, to enable material scraped from the lottery ticket to enter said opening and be retained in said housing portion, a portion of said upper generally triangularly shaped member being slidably mounted, and movable to a position in which the scrapings from the lottery ticket can be dumped from said housing portion, into a trash receptacle.

3. The hand held device as recited in claim 1 in which said upper and lower, generally triangularly shaped members are of plastic.

4. The hand held device as recited in claim 3 in which said plastic is transparent.

5. The hand held device as recited in claim 1 in which said blade is metal, and having an upper surface sloping upwardly from the cutting edge, in the direction of said opening.

6. A hand held scraper device involving a generally elongate housing having a central cavity, said housing being defined by a comparatively narrow front portion, diverging side portions, a rear portion, and essentially flat top and bottom portions, said narrow front portion being rearwardly slanted, with a flat blade located at the bottom of said narrow front portion, in a position readily visible to the user of the scraper, closely located above which blade is a slot, said blade being usable as a scraping tool by a person grasping said generally elongate housing, by the use of which blade, selected portions of the surface layer of a lottery ticket or the like can be carefully removed, with scrapings from the lottery ticket entering said slot for retention in said cavity.

7. A hand held scraper device involving a generally elongate housing having a central cavity, said housing being defined by a comparatively narrow front portion, diverging side portions, a rear portion, and essentially flat top and bottom portions, said narrow front portion having a flat blade, closely located above which is a slot, said blade being usable as a scraping tool by a person grasping said generally elongate housing, by the user of which blade, selected portions of the surface layer of a lottery ticket or the like can be carefully removed, with scrapings from the lottery ticket entering said slot for retention in said cavity, a part of said flat top portion being slidably mounted, and movable to a position in which the scrapings from the lottery ticket can be dumped from said central cavity, into a trash receptacle.

8. A hand held device as recited in claim 6 in which said top and bottom portions are of plastic.

9. A hand held device as recited in claim 8 in which said plastic is transparent.

10. A hand held device as recited in claim 6 in which said blade is metal, with its upper surface sloping upwardly in the direction of said slot, thereby to assist the scrapings moving in the direction of said slot, and then entering same.

* * * * *